US007186153B2

(12) United States Patent
Boettger

(10) Patent No.: US 7,186,153 B2
(45) Date of Patent: Mar. 6, 2007

(54) SIDE ENTRY TERMINAL PIN

(75) Inventor: John Boettger, Fayetteville, NY (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 10/965,165

(22) Filed: Oct. 13, 2004

(65) Prior Publication Data

US 2006/0079139 A1 Apr. 13, 2006

(51) Int. Cl.
*H01R 4/10* (2006.01)

(52) U.S. Cl. ..... 439/881

(58) Field of Classification Search ..... 439/881
See application file for complete search history.

(56) References Cited

U.S. PATENT DOCUMENTS

| | | | | |
|---|---|---|---|---|
| 2,741,753 | A * | 4/1956 | Mekelburg | 439/502 |
| 3,416,122 | A * | 12/1968 | Kinkaid | 439/72 |
| 4,039,244 | A * | 8/1977 | Leachy | 439/887 |
| 4,143,936 | A * | 3/1979 | DeRoss et al. | 439/881 |
| 5,269,713 | A * | 12/1993 | Brezovar et al. | 439/881 |
| 5,730,631 | A * | 3/1998 | Tsang | 439/881 |
| 6,196,885 | B1 * | 3/2001 | Catalino et al. | 439/881 |

* cited by examiner

*Primary Examiner*—Gary F. Paumen
(74) *Attorney, Agent, or Firm*—Bachman & LaPointe, P.C.

(57) ABSTRACT

A terminal pin includes a substantially elongate pin body having a longitudinal axis and a terminal head, the terminal head having an opening for receiving a wire, the opening extending substantially transverse to the longitudinal axis. This results in a substantial reduction in space required as compared to other connection structures.

6 Claims, 1 Drawing Sheet

SIDE ENTRY TERMINAL PIN

BACKGROUND OF THE INVENTION

The invention relates to a terminal pin and, more particularly, to a terminal pin with improved connection to a wire.

Terminal pins are frequently used for connecting various electrical components and wires for conveying current to same. In some instances, pins are required to allow electrical connections to be made through a surface that needs to be sealed from an outside environment. One example of such a situation is in connection with compressor equipment, wherein refrigerant is sealed inside the device.

A typical pin has a longitudinal bore formed therein, and a wire is crimped into the bore. In order to save space, other configurations can be used. For example, a separate bolt positioned within the bore and a wire-connector such as a flattened member with an aperture positioned over the bolt, can be used. Washers can also be needed. While this provides for secure connection and reduced space, there is added cost involved in forming of the longitudinal bore in the pin and in connection with the bolt and connector hardware.

The need exists for a more cost effective and reliable method for connecting pins and wires in sealed in a sealed environment with limited space.

It is therefore the primary object of the present invention to provide an improved terminal pin which meets this objective.

It is a further object of the present invention to provide a terminal pin which is simple and reliable in use.

Other objects and advantages of the present invention will appear herein below.

SUMMARY OF THE INVENTION

In accordance with the present invention, the foregoing objects and advantages have been readily attained.

According to the invention, a terminal pin is provided which comprises a substantially elongate pin body having a longitudinal axis and a terminal head, the terminal head having an opening for receiving a wire, the opening extending substantially transverse to the longitudinal axis.

In further accordance with the invention, a method is provided for connecting a pin and a wire, wherein the method comprises the steps of: providing a terminal pin comprising a substantially elongate pin body having a longitudinal axis and a terminal head, the terminal head having an opening for receiving a wire, the opening extending substantially transverse to the longitudinal axis; positioning a wire in the opening; and crimping the terminal head of the pin so as to secure the wire in the opening.

The opening can advantageously be substantially perpendicular to the longitudinal axis of the pin. Further, the terminal end can advantageously have a concave surface which advantageously acts as a crimping surface whereby application of a force to the concave surface crimps a wire within the opening.

BRIEF DESCRIPTION OF THE DRAWINGS

A detailed description of preferred embodiments of the present invention follows, with reference to the attached drawings, wherein.

DETAILED DESCRIPTION

The invention relates to a side entry terminal pin having a simplified structure for connecting to a wire. Such a pin is particularly useful in various types of equipment wherein electronic components are to be connected to wires. For example, such pins are particularly useful in power connections to the motor of a compressor.

Figure 1:
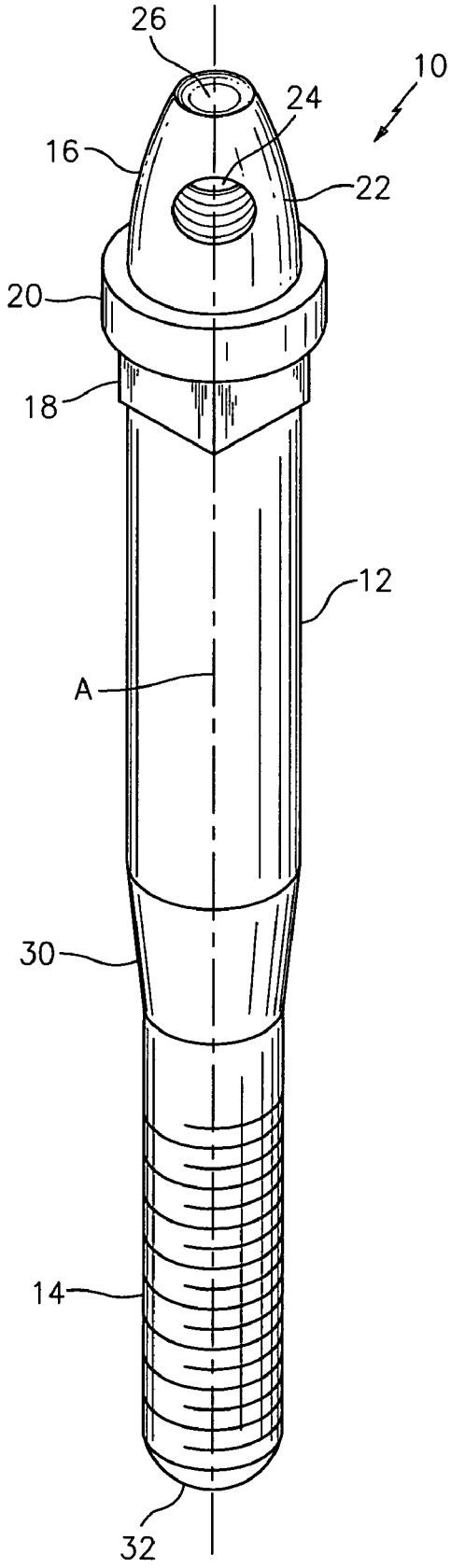
FIG. 1 is a perspective view of a side entry terminal pin in accordance with the present invention.

FIG. 1 shows a perspective view of a pin 10 in accordance with the present invention. Pin 10 has a substantially elongate pin body 12 having a longitudinal axis A. Pin 10 has a threaded end 14 which is typically used for securing within an electronic component or piece of machinery as is well known to a person of ordinary skill in the art. Pin 10 also has a terminal head 16 which is adapted to connect to a wire, and the structure of terminal head 16 is the thrust of the present invention.

Terminal head 16 is advantageously defined at one end of pin 10, and this end of the pin can typically have a flatted portion 18, a flange 20, and an extension 22 extending to the end of pin 10 from flange 20 as shown in FIG. 1. An opening 24 is positioned in extension 22, and can advantageously extend completely through extension 22. Opening 24 is advantageously positioned substantially transverse to longitudinal axis A of pin 10, such that a wire to be positioned within opening 24 enters opening 24 from the "side" of extension 22. It should be appreciated that substantially transverse as used herein does not require a perpendicular orientation. Even an angle of 45° with respect to axis A would be considered to fall within the broad scope of the present invention. A particularly preferred orientation, however, is substantially perpendicular.

Figure 2:
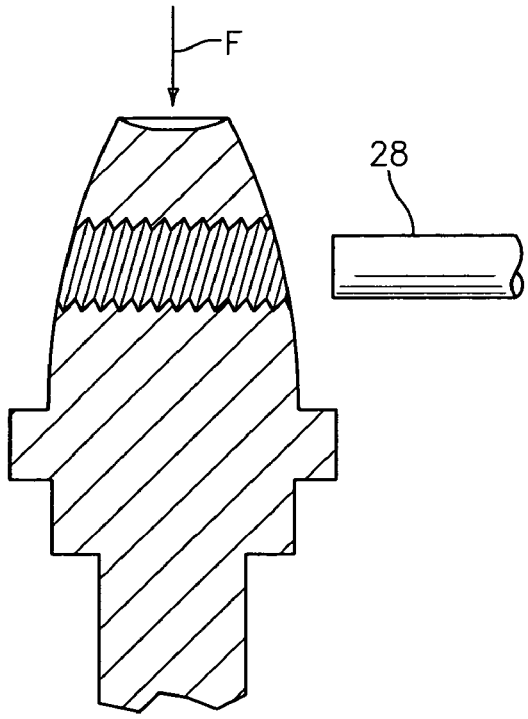
FIG. 2 is a side sectional view of a portion of the pin of FIG. 1.

Flange 20 can advantageously be a substantially rounded member, while extension 22 can advantageously have a substantially narrowing surface, which narrows in a direction away from flange 22, as shown in FIGS. 1 and 2.

In accordance with the embodiments shown in FIGS. 1 and 2, extension 22 has a substantially conical shape, which is a desirable shape from the standpoint of simple and easy manufacture. Of course, extension 22 could have other shapes as well, all of which are considered to be within the broad scope of the present invention.

Still referring to FIGS. 1 and 2, extension 22 can advantageously have a substantially concave end surface 26. End surface 26, and the concave nature thereof, serves to provide an excellent surface upon which a crimping force F can be applied as is schematically illustrated in FIG. 2.

Opening 24 can be formed having a smooth inner bore, or can preferably be formed having a threaded inner bore so that crimping creates a better grip upon a wire positioned therein.

In accordance with a particularly preferred aspect of the present invention, extension 22 and opening 24 are defined as an integral portion of the rest of pin 10 such that a single unitary element, (i.e. one piece of material), provides the pin, flange and connecting structure for crimping of a wire to extension 22. This results in a reduced-space connection without the additional hardware originally thought needed to provide a suitable connection. This is a substantial saving in cost of the connection as compared to connections using an additional bolt, or an additional connecting member which must be connected to the end of a wire. Thus, the present invention provides a connection with reduced space requirements and without the added expense of extra parts.

It should therefore be readily appreciated that pin 10 in accordance with the present invention advantageously provides for a far simpler and more cost effective method of connecting a wire to the pin, which is particularly useful when connecting to electrical components in sealed environments.

In accordance with the invention, connection is carried out by providing a pin 10 such as that shown in FIGS. 1 and 2 and described above, by positioning a wire 28 (FIG. 2) within opening 24, and by applying crimping force F to surface 26 to deform extension 22 and close walls of opening 24 upon the outside surface of wire 28. This advantageously secures wire 28 firmly within opening 24 as desired. The inside surface of opening 24 can be provided with ridges or other gripping structures if desired, to enhance the hold on wire 28 secured within opening 24.

Pin 10 in accordance with the present invention can advantageously be provided from any suitable material. Particularly preferred materials include copper, steel and the like, and copper is preferred.

Returning to FIG. 1, elongate pin body 12 can advantageously have a central portion which is substantially smooth walled, and which transitions in one direction to flatted portion 18, then flange 20 and finally extension 22 with end surface 26. In the opposite direction, pin 10 has a tapered portion 30 leading to threaded portion 14 and opposites end 32 of pin 10. The smooth walled portion is useful for sealing, and a rubber grommet (not shown) can be positioned around the smooth walled surface to provide a seal as may be desired.

This structure is particularly useful in various different desired connections of electrical components to wiring, particularly when limited space is available and the components are within a sealed environment, and also where connection is to be made to heavy machinery components such as the motor for driving a compressor and the like.

It should readily be appreciated that pin 10 in accordance with the present invention is a substantial improvement over conventional devices by avoiding the need for separate bolts, wire connecting structures, washers and the like, and also by avoiding the relatively expensive procedure of forming a longitudinal bore in the end of the pin.

It is to be understood that the invention is not limited to the illustrations described and shown therein, which are deemed to be merely illustrative of the best modes of carrying out the invention, and which can be modified in form, size, arrangement of parts and details of operation. The invention rather is intended to encompass all such modifications which are within its spirit and scope as defined by the claims.

What is claimed is:

1. A terminal pin, comprising a substantially elongate pin body having a longitudinal axis and a terminal head, the terminal head having an opening for receiving a wire, the opening extending substantially transverse to the longitudinal axis, wherein the terminal head comprises a flange and an extension from the flange, and wherein the opening extends through the extension, wherein the extension has an end with a concave surface defined thereon, whereby application of a crimping force to the concave surface deforms the extension so as to secure a wire within the opening.

2. The pin of claim 1, wherein the extension is a substantially conical member.

3. The pin of claim 1, wherein the opening is substantially perpendicular to the longitudinal axis of the pin body.

4. The pin of claim 1, wherein the pin body and terminal end are a single unitary structure.

5. The pin of claim 1, further comprising at least one ridge inwardly extending from the opening to grip a wire positioned therein.

6. A terminal pin, comprising a substantially elongate pin body having a longitudinal axis and a terminal head, the terminal head having an opening for receiving a wire, the opening extending substantially transverse to the longitudinal axis, wherein the terminal head has an end with a concave surface defined thereon, whereby application of a crimping force to the concave surface deforms the terminal head so as to secure a wire within the opening.

* * * * *